United States Patent [19]

Rabinowitz

[11] 3,934,929

[45] Jan. 27, 1976

[54] ADJUSTABLE DENTAL CHAIR

[75] Inventor: Azriel Jay Rabinowitz, Rochester, N.Y.

[73] Assignee: Sybron Corporation, Rochester, N.Y.

[22] Filed: Sept. 3, 1974

[21] Appl. No.: 502,446

[52] U.S. Cl. ..... 297/75; 297/90; 297/319; 297/330

[51] Int. Cl.[2] ..... A47C 1/06; A61G 15/00

[58] Field of Search ..... 297/75, 71, 83, 319, 330, 297/90

[56] References Cited

UNITED STATES PATENTS

| | | | |
|---|---|---|---|
| 2,266,055 | 12/1941 | Luckhardt et al. | 297/83 |
| 2,714,922 | 8/1955 | McKibban et al. | 297/330 X |
| 3,381,997 | 5/1968 | Fritz et al. | 297/319 X |
| 3,476,495 | 11/1969 | Church | 297/83 |
| 3,578,379 | 5/1971 | Taylor et al. | 297/71 |
| 3,804,460 | 4/1974 | Leffler | 297/71 |

*Primary Examiner*—Francis K. Zugel
*Attorney, Agent, or Firm*—Theodore B. Roessel; Roger Aceto

[57] ABSTRACT

The dental chair is provided which has pivotally connected back, seat and footrest sections, the seatrest being journaled in turn to a base member. A motor carried by the seat and connected to the backrest provides for articulation of the backrest relative to the seat. A link extending between the back and footrest provides for articulation of the footrest relative to seat and a cam connected between the link and seat provides for articulation of the seat about the base member; all movements being accomplished simultaneously upon operation of the motor.

6 Claims, 2 Drawing Figures

ADJUSTABLE DENTAL CHAIR

BACKGROUND OF THE INVENTION

The present invention relates generally to articulated dental chairs and more particularly to a dental chair wherein articulation of the back, seat and footrest sections are accomplished in synchronism upon operation of a single motor.

Dental chairs are known in which the back, seat and footrest sections are articulated relative to each other upon actuation of a single motor. For example, as the backrest is moved from an upright to a reclined position, it is desirable to simultaneously elevate the footrest and to tilt the chair slightly. This permits the dentist to smoothly translate the patient through all operative positions while minimizing excessive positioning decisions on his part.

Further, it is desirable to have the backrest pivoted at a location simulating the theoretical hip joint of the patient. In most chairs, the center of rotation of the chairback doesn't coincide with the center of rotation of the patient's back (the hip joint). As a result, during inclination of the backrest, the curve traced by a point on the back of the patient's head, does not coincide with a curve traced by a corresponding point on the headrest of the chair. The headrest thus appears to pull away from the patient's head during inclination and causes discomfort to the patient. When fully inclined, the patient must readjust his position for his comfort and to enable the dentist to work more effeciently. When the chairback rotates back up, because of the patient's new position, the chairback tends to "pinch" the patient in the lower back region.

Under the pivoting conditions described in this invention, the curve traced by a point on the back of the patient's head, does coincide with the corresponding point on the headrest. As such, there is no discomfort to the patient while being positioned into the supine position, no need for the patient to readjust when supine, and no discomfort to the patient when being returned to the upright position.

SUMMARY OF THE INVENTION

The present invention may be characterized in one aspect thereof by the provision of a dental chair having articulating back, seat and footrest sections; a link interconnecting the backrest and the footrest; cam means interconnecting the link and seatrest; and a motor carried by the seatrest and operatively connected to the backrest for articulating the backrest relative to the seatrest, the footrest and seatrest in turn being articulated responsive to movement of the backrest via the link and cam means respectively.

OBJECTS OF THE INVENTION

It is an object of the present invention to provide a dental chair having simultaneously adjustable back, seat and footrest sections wherein the backrest articulates at the theoretical hip joint of the patient.

Another object of the present invention is to provide a dental chair wherein the footrest is elevated and the seatrest tilted upon reclining the chair back.

A further object of the present invention is to provide a dental chair having independent means to vary the elevation of the footrest.

Yet another object of the present invention is to provide a dental chair wherein the operation of a single motor acts to recline the chair back, elevate the footrest and tilt the seatrest sections of the chair.

These and other objects, advantages and characterizing features of the present invention will become more apparent upon consideration of the following detailed description thereof when taken in consideration of the accompanying drawings depicting the same.

DESCRIPTION OF THE PREFERRED EMBODIMENTS

Figure 1:
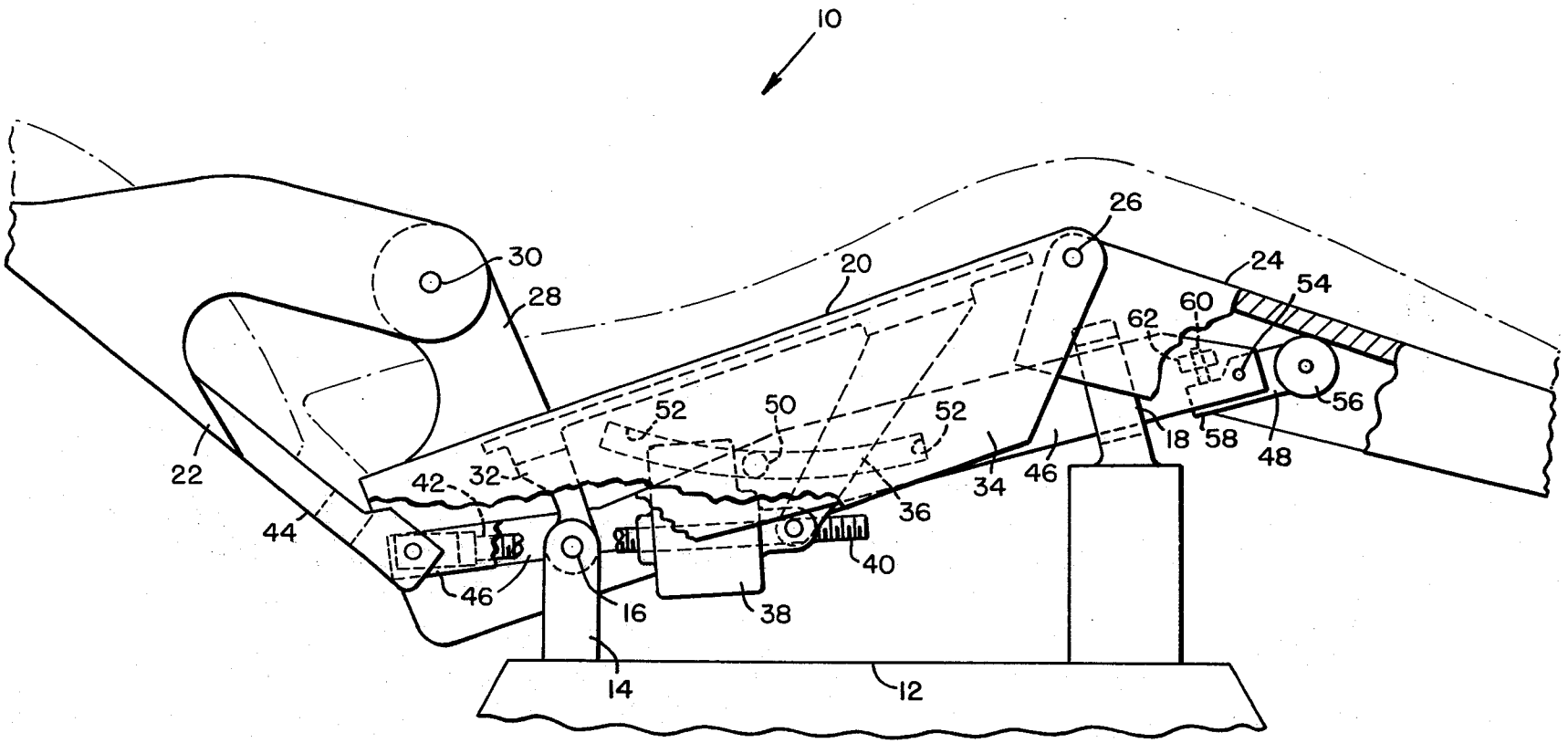
FIG. 1 is a side elevation view of the dental chair in a partly declined position, portions of the chair being broken away and in section for purposes of illustration.

Referring to the drawings, FIG. 1 shows the dental chair of the present invention generally indicated at 10. The chair includes a base portion 12, only a portion of which is shown in the figure. At the rear of the base is a pair of spaced supports 14. Extending between the supports is a axle 16, the purpose of which is set out hereinbelow. Upstanding at the forward end of the base is a slide bearing 18, the purpose of which is also set out hereinbelow.

The patient support portion of the dental chair includes a seatrest 20, a backrest 22 and a footrest 24. The footrest is pivoted to the seatrest at 26 and the backrest is pivoted to an upstanding extension 28 of the seatrest at 30. Locating pivot 30 on an upstanding portion of the seatrest locates this pivot at the theoretical hip joint of the patient.

The seatrest includes a cross head member 32, a pair of side wall members 34 and a depending clevis 36. Cross head 32 is journaled to axle 16 so that the seatrest can be tilted with respect to base 12.

Figure 2:
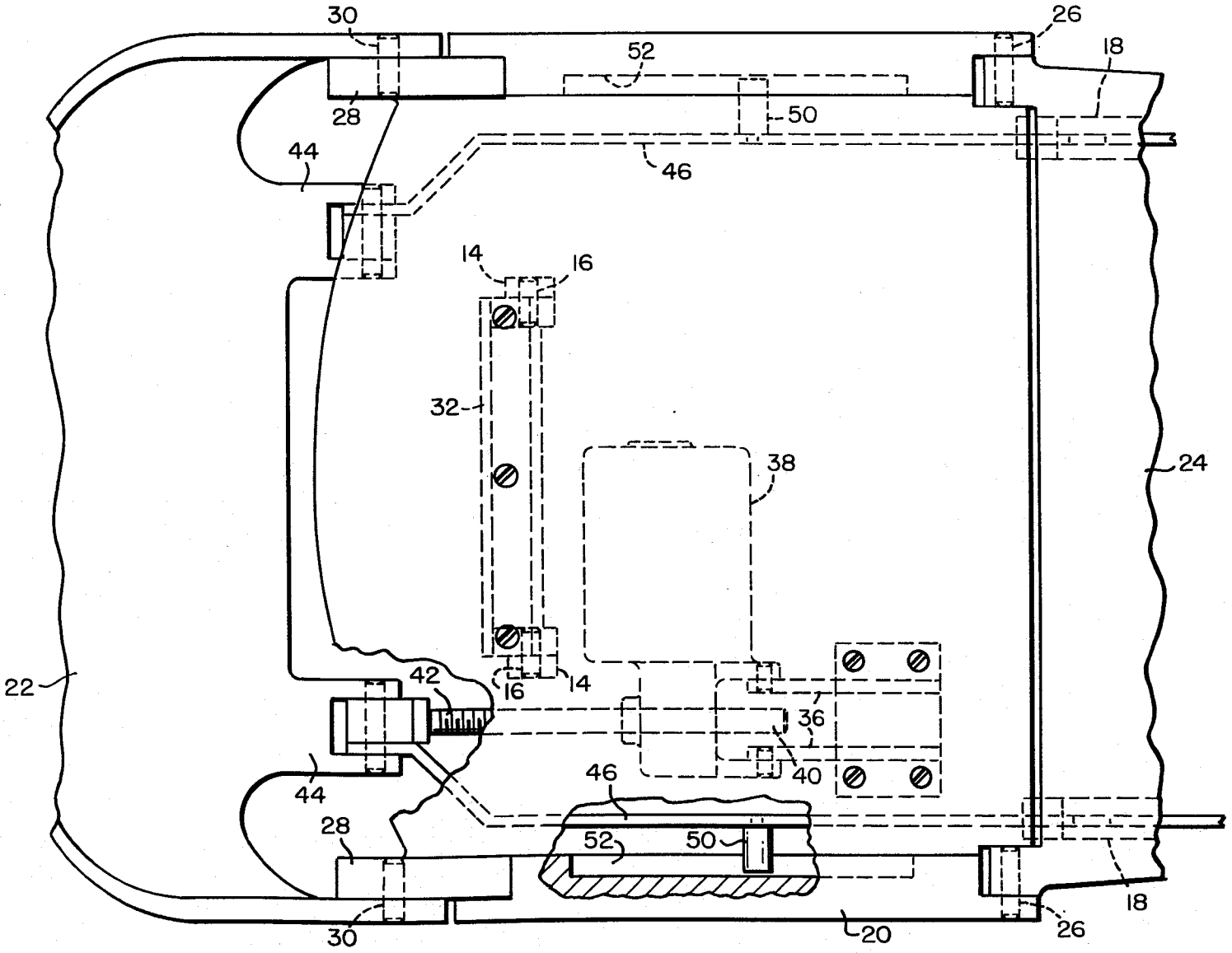
FIG. 2 is a plan view of a part of the chair, portions being removed for purposes of clarity.

Pivoted to the depending end of clevis 36 is a reversable motor 38. Motor 38 is of the type which has an internal nut which is rotated to translate a drive screw 40 to the left or right as viewed in the FIG. 1. One end 42 of the screw is attached to an extension 44 of the backrest. As best seen in FIG. 2, this attachment is at a position outboard of the crosshead. Thus, as the motor is operated to translate screw 40 to the left or the right as viewed in the figure the screw will respectively push or pull on backrest extension 44 to elevate or lower the backrest with respect to seat 20, this movement or articulation being accomplished about pivot 30.

Also connected to backrest extension 44 adjacent the screw connection is one end of a link 46. FIG. 2 shows that a pair of such links are provided one at each side of the chair. However, as the construction and function of both links is the same, only one will be described in detail. The link extends through bearing 18 and has an adjustable extension 48 which contacts footrest 44. With this arrangement, movement with the backrest is transmitted through the link to the footrest so that as the backrest is lowered, the footrest is elevated and visa versa, as the backrest is raised, the footrest is lowered.

Intermediate its ends, link 46 carries a cam follower 50 which is engaged in a arcuate cam groove 52 formed in the side wall 34 of the seatrest. With this cam connection, the seatrest is likewise tilted up or down about axial 16 as the backrest is lowered and raised respectively.

In operation then, whatever the dentist desires to adjust the position of the plaintiff. Suitable controls on the dental chair (not shown) are operated to energize motor 38. For example, assuming that the chair is to be adjusted from the reclining position shown in the drawing to an upright position, the motor is energized so as to move lead screw 40 to the left as view in the figure. As screw 40 is translated to the left, it exerts a pushing force on backrest extension 44 to pivot backrest upwardly about pivot 30. At the same time, this upward movement of the backrest pulls link 46 causing the link also to translate to the left as viewed in the figure. This translation of link 46 has two resulting motions, first of all, it allows footrest 24 to lower and secondly, the cam connection between cam follower 50 and the arcuate cam groove 42 causes a seatrest 20 to tilt downwardly about its pivot 16. In this manner then, the articulation of the backrest, footrest and the tilting of the seatrest are accomplished simultaneously. An opposite adjustment of the dental chair is accomplished by reversing motor 38 to translate screw 40 to the right as viewed in the figure.

As set forth herein above, link extension 48 may be independently adjusted and set to control the relative positioning of footrest 44. In this respect, the extension is pivoted intermediate its ends to link 46 at 54. One end of the extension carries a roller member 56 which directly contacts footrest 44. The other end 58 of the extension is contacted by a screw member 60 which is threaded through a link portion 62. By turning screw 60, it is possible to rotated extension 48 slightly about pivot 54. Depending upon the direction of the rotation, the link extension will either increase or decrease the respective length of the link which in turn will slightly raise or lower the footrest. Once the relative position of the footrest has been set with screw 60, the footrest will maintain this relative positioning as the various sections of the chair are articulated as set forth hereinabove.

Thus, it should be appreciated that the present invention accomplishes it intended objects in providing a dental chair wherein the articulations of the backseat and footrest sections are accomplished simultaneously and in a coordinated manner. Only a single motor is used to affect the coordinated movement of the various chair sections. In addition, a simple one screw adjustment is provided for initially setting the position of the footrest section with respect to the other sections of the chair.

Having thus described the invention in detail, what is claimed as new is:

1. A dental chair comprising:

a. pivotally connected back, seat and footrest sections;

b. a base having a rearward portion pivotally supporting said seatrest section and a forward guide portion;

c. motor means carried by said seatrest section and operatively connected to said backrest section for articulating said backrest relative to said seatrest;

d. a linearly movable link connected to said backrest and extending through said guide portion to contact said footrest section for articulating said footrest responsive to movement of said backrest; and e. cam means connecting said link and seatrest section for articulating said seatrest about said rearward portion responsive to movement of said backrest.

2. A dental chair as in claim 1 in which said backrest is pivotally supported at a point spaced above said seatrest and has a lower extension, one end of said link being connected to said backrest extension.

3. A dental chair as in claim 2 comprising:

a. a clevis depending from said seatrest; and b. said motor means including a reversible drive motor pivotally connected to said clevis and a screw translated by said drive motor, one end of said screw being connected to said backrest extension.

4. A dental chair as in claim 2 wherein said cam means comprises:

a. an arcuate cam slot in said seatrest; and b. a cam follower on said link engaged in said slot.

5. A dental chair as in claim 3 wherein said drive motor is of the type having an internal rotating drive nut wherein said nut rotates to translate said screw in a rotation free manner.

6. A dental chair as in claim 1, wherein the length of said link is adjustable and includes:

a. a member pivoted intermediate its ends to one of said link;

b. a roller on said member engagable against said footrest c. means on said link for rotating said member about said link end to adjust the effective length of said link.

* * * * *